United States Patent [19]

Nagel

[11] 4,265,394

[45] May 5, 1981

[54] FLUE DAMPER CONTROL SYSTEM

[75] Inventor: George W. Nagel, Forest Hills Boro, Pa.

[73] Assignee: Westinghouse Electric Corp., Pittsburgh, Pa.

[21] Appl. No.: 79,679

[22] Filed: Sep. 28, 1979

[51] Int. Cl.[3] ..... F23N 3/00; F23L 11/00; G05D 23/00

[52] U.S. Cl. ..... 236/1 G; 431/20; 126/285 B; 318/471; 318/160; 307/252 B

[58] Field of Search ..... 236/1 G; 431/20; 126/285 B; 318/471, 473, 476, 334, 160; 307/252 B

[56] References Cited

U.S. PATENT DOCUMENTS

| | | | |
|---|---|---|---|
| 3,743,182 | 7/1973 | Harmon et al. | 318/160 |
| 3,829,010 | 8/1974 | Jones | 318/471 |
| 4,017,024 | 4/1977 | Grostick et al. | 236/1 G |
| 4,046,318 | 9/1977 | Ripley | 126/285 B |

*Primary Examiner*—William E. Wayner
*Assistant Examiner*—Harry Tanner
*Attorney, Agent, or Firm*—E. C. Arenz

[57] ABSTRACT

In a flue damper control system, a thermistor 64 responsive to flue temperatures upstream of the damper 12 is incorporated in a trigger circuit for a triac 52 which controls energization and deenergization of the damper motor 17, the damper motor being fully energized only when the flue temperature is below a predetermined value and there is no demand for heat by the thermostat 36.

5 Claims, 4 Drawing Figures

FLUE DAMPER CONTROL SYSTEM

BACKGROUND OF THE INVENTION

The invention pertains to the art of the the electrically actuated vent or flue dampers used to save energy in domestic furnaces and the like.

There are a number of different types of electrically actuated flue dampers on the market intended for reducing the heat loss from such furnaces caused by unrestricted convective transport of heated interior air up the chimney or flue during those periods when the furnace is not in operation. Obviously, the damper must be open while the furnace is firing. Usually this is done by having the closure of the room thermostat call for the damper to open, and only after such opening has been verified by the closure of an interlock switch is the furnace gas valve or oil burner motor energized.

A number of furnaces now in the field are fitted with manual actuators on their gas valves to permit emergency operation of the furnaces during power outages when solenoid actuation of the gas valves is impossible. The design of the dampers now in the market are required to be such that the damper will be open when such furnaces are under manual control. In a number of arrangements the damper is held shut by electric power and is self-opening by stored energy in biasing means when the power goes off. Of course this will cover normal usuage of the manual operation option of such a furnace. However, there still remains the possibility that someone will manually force the furnace into operation even while power is available which would keep the damper closed. Obviously, this would be a dangerous situation since combustion gases, possibly toxic in nature, would be prevented for the most part from going up the chimney and would be released into the house. Tentative or now existing standards regarding automatic furnace dampers deal with this potential danger by requiring either that the furnace be fitted with a redundant gas valve which cannot be manually actuated, or that the damper itself respond to the presence of hot combustion products to open without a thermostat command. The first option, that of installing a second main gas valve and including its actuation into the normal furnace operation, is considered prohibitively expensive in a retrofit situation. Thus, of those electrically actuated dampers with which I am familiar, and which are intended for use in the retrofit market, all incorporate a normally-closed thermostat in the flue in series with the motor or solenoid which holds the damper closed against the damper opening biasing means.

Such flue thermostats, which typically are of the type commonly used for over heat limit purposes in conventional furnace control systems, consist of one portion such as a helical bi-metal which responds mechanically to the temperature change in such a way that it operates a set of discrete electrical contacts. By the nature of their construction and the quantity of material required, they have some minimum cost no matter how much the electrical rating is reduced. It would be desirable in my estimation if a control system were devised which could eliminate the mechanical flue thermostat.

In considering the possibility of devising a control system in which the mechanical flue thermostat can be eliminated, another consideration enters into the system in connection with the fact that the damper actuator must be energized when the room thermostat does not supply power, and be deenergized when the room thermostat does supply power. As a result, in such systems there is incorporated an electrical inversion device which, conventionally, has been a relay. Relays offer the circuit inversion nicely as well as power gains if required. However, relays are again a manufactured device of many discrete parts so again there is a minimum cost involved no matter how small the electrical rating. Accordingly, in my estimation it would be considered desirable if a control system could be devised which eliminated the relay without a concomitant penalty to the system as a whole because of the inclusion of other similar cost devices to carry out the equivalent function of the relay.

It is the aim of the invention to provide a control system for a flue damper assembly which eliminates the mechanical flue thermostat and relay and utilizes other devices to accomplish the equivalent functions and at less cost for the control system.

SUMMARY OF THE INVENTION

In accordance with the invention, there is provided for a flue damper control system of the type which includes electrically energized damper motive means required to be fully energized to hold the damper plate in a closed position in the flue, and has interlock means provided to normally permit fuel flow only when the damper plate is in a open position, has first switch means provided to control energization of the damper motive means, and has a circuit including a thermostatic switch operable in accordance with demand for heat, an improvement by providing the first switch means in the form of a semiconductor switch in the damper motive means circuit, and a trigger circuit for the semiconductor switch including a thermistor responsive to flue temperatures upstream of the damper plate, with the trigger circuit being arranged to turn on the semiconductor switch to fully energize the damper motor means only when the flue temperature is below a predetermined value and there is no demand for heat as indicated by the position of the thermostatic switch.

In the currently preferred form, the semiconductor switch comprises a triac and the damper motive means includes an AC motor, the trigger circuit is connected with the thermsistor in parallel with the thermostatic switch and the thermistor is shorted out when the thermostatic switch is closed so that the triac is always turned off when the thermostatic switch is closed. The thermistor may have a positive temperature coefficient in one circuit configuration, or a negative temperature coefficient in another circuit configuration.

DESCRIPTION OF THE PREFERRED EMBODIMENT

Figure 1:
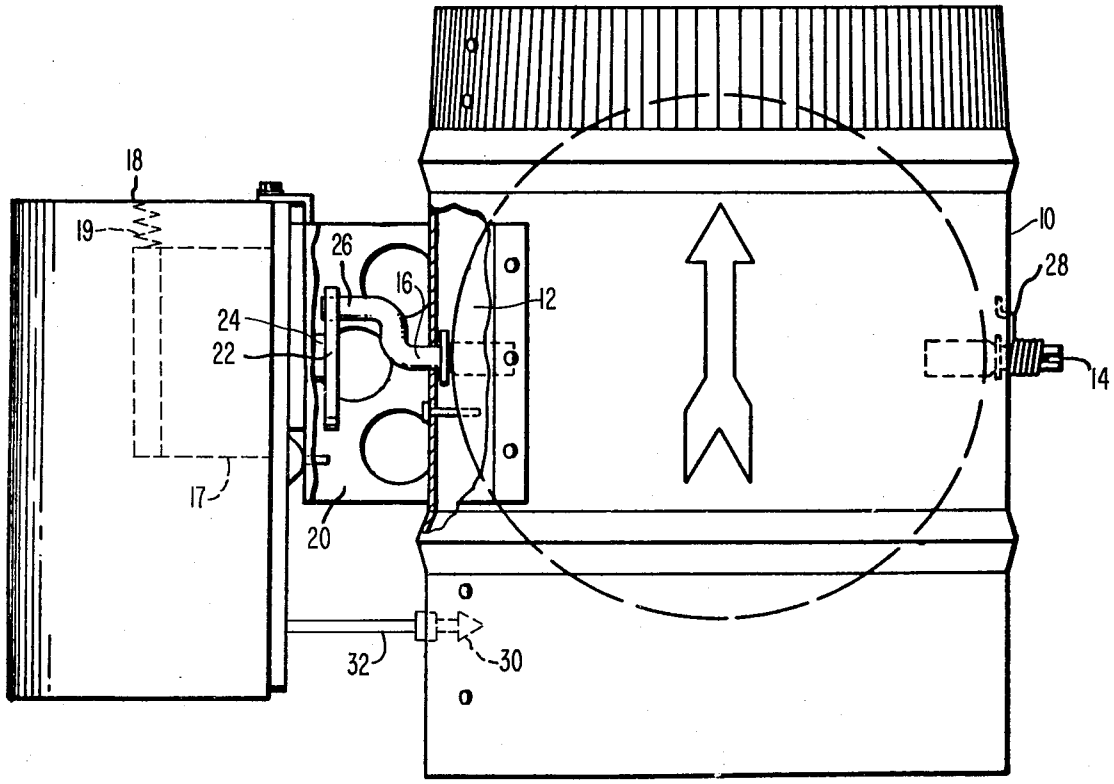
FIG. 1 is a partly broken side view of a damper assembly of the type in which my invention may be incorporated.

While the invention herein basically resides in the control system, the damper assembly as a whole is shown in FIG. 1 and will be described briefly to provide a setting for the description of the invention. Further details of this particular example of a damper assembly in which the invention may be embodied may be found in U.S. Patent Application Ser. No. 900,680, filed Apr. 27, 1978 which is hereby incorporated by reference.

The section 10 of a flue pipe is provided in its internal circular cross section with a damper plate 12 in the form of a flat circular disc supported at diametrically opposite edges by rotatable stub shafts 14 and 16 journalled in openings at opposite sides of the pipe section.

Electrically powered actuator means in the form of a clockwork motor 17 is contained within the box 18 carried from the pipe section by bracket 20 and is arranged, when energized to rotate disc 22. The disc 22 is mounted at the end of motor shaft 24 and has a slot (not shown) which receives the crank end 26 of stub shaft 16 to transmit the turning motion to the damper plate which moves from its illustrated open position to a closed position.

The actuator means as disclosed in the noted patent application is provided with biasing means in the form of springs 19 diagrammatically shown in FIG. 1 which will drive the actuator motor 17 toward a damper open position in the absence of energization of the motor. As illustrated in FIG. 1, second biasing means in the form of a helical spring 28 cooperates with the shaft 14 to drive the damper plate to an open position when the actuator means including the disc 22 is removed from the assembly.

A thermistor 30 is located in the flue pipe section upstream of the damper plate and is connected by leads 32 to the box 18 and thence into the control system circuit.

Figure 2:
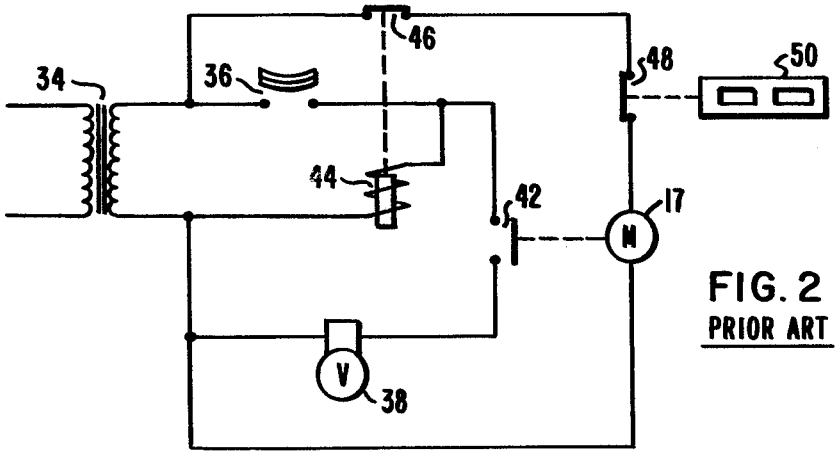
FIG. 2 PRIOR ART
FIG. 2 is a schematic view of a common prior art circuit arrangement for a damper control system.
Figure 3:
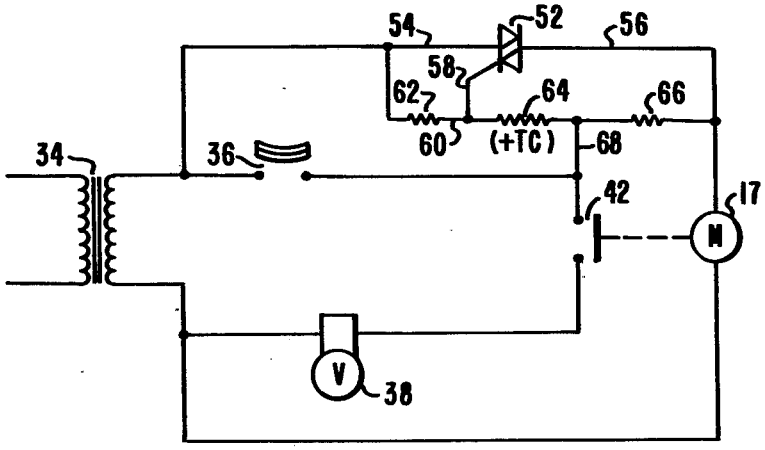
FIG. 3 is a schematic view of one form of circuit arrangement according to invention.

To perhaps aid in better understanding the advance of the invention relative to the prior art, the conventional prior art control system will be described in connection with FIG. 2, and to the extent that components in FIGS. 2 and 3 are identical, identical numerals will be used. The circuit includes transformer 34 which yields the usual 24 volts AC in the secondary, room thermostat 36 which operates from open to closed in response to a demand for heat, a fuel controlling device such as a solenoid controlled gas valve 38 as shown (or a oil pump motor for an oil burner, for example), the damper motor 17 which drives the damper plate shaft means through a gear train, a damper position responsive switch 42, relay means including actuating coil 44 and controlled switch 46, and flue temperature responsive switch 48 controlled by the mechanical thermostat 50 located in the flue pipe upstream of the damper.

The parts are shown in FIG. 2 in their condition corresponding to a lack of demand for heat and with the damper plate in a closed position in the flue. When a demand for heat occurs as evidenced by the closure of room thermostat 36, the circuit to relay coil 44 is closed which results in the opening of switch 46. This deenergizes the damper motor 17 which had been holding the damper plate in a closed position. The biasing means of the actuator means drives the motor in a direction to open the damper plate and as the damper plate closely approaches full open position, the interlock switch 42 responsive thereto closes to complete the circuit for energization of the gas valve solenoid to permit the flow of gas to the burners.

When the room thermostat 36 opens in response to the satisfaction of the demand for heat, the relay coil 44 is deenergized so that its switch 46 closes to permit energization of the damper motor 17 to drive the damper against the biasing means to a closed position. The flue temperature responsive switch 48 function to open above a predetermined sensed temperature in the flue to either prevent the motor from being energized and driven to a closed position, or to deenergize the motor if the damper is in a closed position so that the biasing means will drive the damper to an open position.

Turning now to FIG. 3, those elements of the circuit which are identical to the elements shown in FIG. 2 are given identical numerals. It will be noted that the elements of FIG. 2 which are omitted in FIG. 3 are the relay 44 and its switch 46, and the mechanical flue thermostat 50 with its controlled switch 48. Those elements in FIG. 3 which provide the functional equivalent include a semiconductor switch 52 which as illustrated is a triac having its two main terminals connected to lines 54 and 56 and its gate terminal connected by line 58 to line 60 in the trigger circuit between resistor 62 and a positive temperature coefficient thermistor 64 which in turn is connected to one end of resistor 66 whose other end is connected to the main line 56 to the motor 17. The side of the thermistor opposite the gate is also connected by line 68 to the thermostatic switch control circuit which includes the thermostat 36, the interlock switch 42, and the solenoid of the gas valve 38.

The manner of operation of the control system of FIG. 3 is as follows. In a condition with the furnace having been off for some time so that the flue is cold, and with the room thermostat 36 open indicating a lack of demand for heat, the interlock switch 42 will also be open, and the triac 52 will be on or firing (that is, while it goes off at the end of each half cycle, it then refires at the beginning of each next half cycle) so that the motor 17 is energized and holds the damper plate in a closed position. The thermistor 64 is selected with a resistance when cold which is comparable to the resistance of resistor 62. Thus a signal is constantly provided through the line 58 to the gate of the triac 52.

When the room thermostat 36 closes in response to a demand for heat, the trigger circuit is shorted out and the signal at the gate which permitted the continual firing of the triac 52 is removed. This deenergizes the motor 17 which permits the biasing means 19 (FIG. 1) to drive the motor in a reverse direction and at the same time open the flue damper. As the flue damper reaches its open position, the interlock switch 42 will close and the solenoid for the gas valve 38 will be energized. As the flue gets hot the thermistor 64 will become a relatively high resistance. However, this has no effect at this time since the triggering circuit is shorted out.

When the thermostat 36 is satisfied, it opens and the solenoid for the gas valve is effectively deenergized since the value of the resistance of resistor 62 along with that of the thermistor 64 is far too high to permit sufficient current to the solenoid to maintain it in an open position. At this time with the thermistor 64 still having a relatively high resistance, the triac 52 will receive an inadequate signal to fire it. However as the flue cools down the reducing resistance of the thermistor 64 will reach the point where the signal to the gate is adequate for the triac to fire and the motor 17 is then again energized, and drives the damper plate to a closed position and opens the interlock switch.

If the gas valve should for some mechanical reason stick open while the furnace is firing and after the thermostat 36 has been satisfied, the high resistance of the thermistor 64 will prevent a signal to the triac which would permit the triac to be fired. Hence, the damper plate will remain in an open position until after the gas flow to the furnace has been stopped. In this type of situation, the increasing interior temperature in the space served by the furnace should serve notice to the occupants of some defect in connection with the furnace system.

If in some way the gas valve should be opened while the thermostat 36 is in a position indicating no need for heat, the hot flue gases will raise the resistance of the thermistor 64 to a point which cuts off the triac 52, thus deenergizing motor 17 which permits the biasing means to drive the damper plate to an open position. Again the furnace can continue to runindefinitely in a safe flue-open position until the gas is shut off in response to the rising temperatures sensed by the occupants.

Resistor 66 is selected with a sufficiently high resistance so that any current through it when the room thermostat 36 is closed is insufficient to prevent the biasing means from driving the motor 17 in a damper plate opening direction, and so that the resistor's power dissipation is relatively small.

Figure 4:
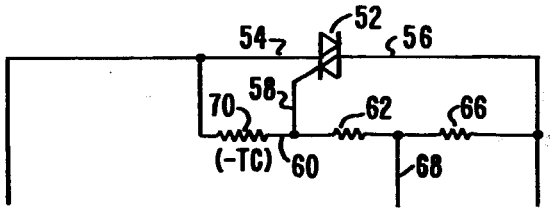
FIG. 4 is a schematic view of a fragmentary portion of a circuit arrangement which may be used in lieu of part of the circuit arrangement of FIG. 3.

Referring now to FIG. 4, the trigger circuit here is provided with a thermistor 70 having a negative temperature coefficient in place of the trigger circuit including a positive temperature coefficient thermistor 64 of FIG. 3. The circuit works in essentially the same way as that of FIG. 3. With the room thermostat 36 open, the furnace off, the flue cold, the thermistor 70 has aresistance comparable to resistor 62, so that the triac is firing and the motor 17 will be energized with the flue being closed by the damper plate.

When the room thermostat 36 closes, the thermistor 70 is shorted so that the signal to the triac is lost and the triac shuts off so that motor 17 is deenergized and the damper plate moves to an open position. When the damper plate reaches its final open position, the interlock switch is closed and the gas valve 38 is opened through energization of its solenoid. When the flue gets hot, the thermistor 70 will drop significantly in resistance, but again this has no immediate effect on the triac operation.

Now after the space is warmed and the room thermostat 36 opens, the gas valve will be closed by deenergization of its solenoid. It is noted that while the resistance of the thermistor 70 drops in a hot condition there is still too much resistance in the resistor 62 to permit adequate current to the solenoid for the gas valve to permit it to remain open. However, the triac will still be kept from firing until the flue cools sufficiently that the thermistor resistance rises to a value which will give an adequate gate trigger current and voltage to line 58.

If gas valve problems should occur such as discussed before, the system will in both instances continue to operate safely. Thus, if the gas valve should stick open after the thermostat has been satisfied, the continued low resistance of the thermistor 70 will prevent the triac from firing. Or if the gas valve should some how be opened while the system is not in operation, as soon as the hot flue gases lower the resistance of the thermistor 70 adequately, the triac will be turned off and the flue damper will open.

In comparing the control system of the invention with that of the prior art, it will be apparent that the triacis basically providing the same function as the relay 44 and switch 46 of the prior art circuit. While the difference in current cost of a triac and a relay may be insignificant, and thus there would be little justification from that standpoint for using a triac to perform the same function as a relay, the triac does provide the required electrical inversion and more importantly has a very substantial power gain which permits the use of the very small and relatively inexpensive thermistor to control the triac. Thus, while the change to a semiconductor switch device from the relay does not in itself offer any significant savings, that change does make it possible to eliminate the relatively extensive and cumbersome mechanical thermostat from the flue.

The particular resistance values and parameters of the resistors 62, 66, and thermistors 64 and 70 are selected in accordance with the parameters of the particular triac or other semiconductor switch device to be used.

I claim:

1. In a flue damper control system of the type which includes electrically energized damper motive means required to be fully energized to hold the damper plate in a closed position in the flue, and including interlock means provided to normally permit fuel flow only when said damper plate is in an open position, first switch means provided to control energization of said damper motive means, and a circuit including a thermostatic switch operable in accordance with demand for heat, the improvement comprising:

said first switch means comprises a semiconductor switch in the damper motive means circuit; and a trigger circuit for said semiconductor switch including a thermistor responsive to flue temperatures upstream of said damper plate, said trigger circuit turning on said semiconductor switch to fully energize said damper motive means only when said flue temperature is below a predetermined value and there is no demand for heat as indicated by the positions of said thermostatic switch.

2. In a system according to claim 1 wherein:

said semiconductor switch comprises a triac, and said damper motive means includes an AC motor in the damper motive means circuit.

3. A system according to claim 2 wherein:

said trigger circuit is connected with said thermistor in parallel with said thermostatic switch, said thermistor being shorted out when said thermostatic switch is closed so that said triac is turned off when said thermostatic switch is closed.

4. A system according to claim 3 wherein:

said thermistor has a positive temperature coefficient, and said trigger circuit includes resistor means.

5. A system according to claim 3 wherein:

said thermistor has a negative temperature coefficient and said trigger circuit includes resistor means.

* * * * *